United States Patent [19]

Hirzel

[11] Patent Number: 5,007,442

[45] Date of Patent: Apr. 16, 1991

[54] DOUBLE BLOCKING MEMBERS SEALING A SINGLE OPENING MEANS

[76] Inventor: Suzy C. Hirzel, 933 Shellwood Way, Sacramento, Calif. 95831

[21] Appl. No.: 404,110

[22] Filed: Sep. 6, 1990

Related U.S. Application Data

[63] Continuation of Ser. No. 142,027, Jan. 11, 1988, abandoned.

[51] Int. Cl.[5] ..... A45D 40/26

[52] U.S. Cl. ..... 132/218; 132/120

[58] Field of Search ..... 132/120, 216, 217, 218; 401/9, 10; 15/206

[56] References Cited

U.S. PATENT DOCUMENTS

| | | | |
|---|---|---|---|
| 741,722 | 10/1903 | Reynolds et al. | 15/167.1 |
| 2,004,044 | 6/1935 | Fiegel | 132/120 |
| 2,101,132 | 12/1937 | Daly et al. | 401/10 |
| 2,181,448 | 11/1939 | Behr | 132/120 |
| 2,252,551 | 8/1941 | Brosllier et al. . | |
| 2,323,595 | 7/1943 | Hanisch | 407/10 |
| 2,463,611 | 3/1949 | Green et al. | 401/10 |
| 2,630,126 | 3/1953 | Buhrer | 132/120 |
| 2,672,875 | 3/1954 | Kovacs | 132/120 |
| 2,829,655 | 4/1958 | Bau | 132/218 |
| 3,133,546 | 5/1964 | Dent | 132/120 |
| 3,625,229 | 12/1971 | Silson | 132/216 |
| 3,908,676 | 9/1975 | Levine et al. | 132/218 |
| 4,341,231 | 7/1982 | Costa | 132/218 |
| 4,458,701 | 7/1984 | Holland . | |
| 4,527,575 | 7/1985 | Vasas | 132/218 |
| 4,565,205 | 1/1986 | Taylor | 132/218 |
| 4,660,582 | 4/1987 | Taylor | 132/320 |

FOREIGN PATENT DOCUMENTS

| | | | |
|---|---|---|---|
| 452810 | 5/1968 | Switzerland | 401/10 |

*Primary Examiner*—Paul J. Hirsch

[57] ABSTRACT

A tong shape apparatus comprised of a right rod and left rod, each rod having an applicator at its lower ends and upper ends connected by a pivot on a spring action. This method will seal the contents of the dispenser which has a single opening. In beteween the applicators and pivot, there are blocking members which divide the rods into lower and upper sections. The upper section may be used as a handle. When the tong is in a closed position, applicators, rods and blocking members match to form one unit, which makes insertion into a single opening of the dispenser. The blocking members protect the contents and applicators, and also insure that the upper rods and handles remain above the opening.

5 Claims, 3 Drawing Sheets

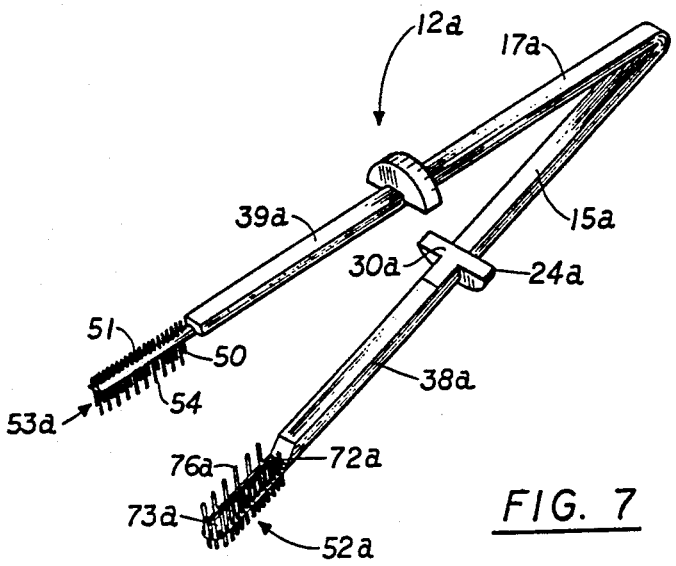
FIG. 7
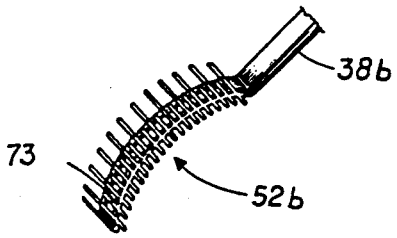
FIG. 8
FIG. 9
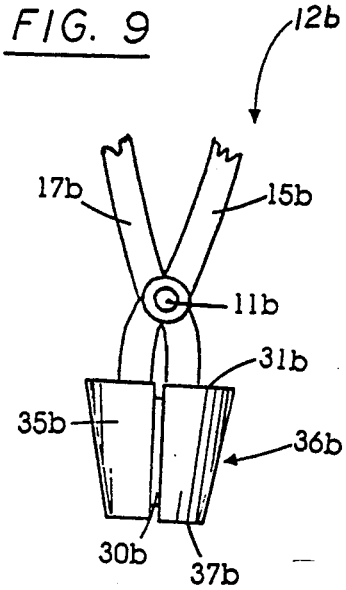

DOUBLE BLOCKING MEMBERS SEALING A SINGLE OPENING MEANS

BACKGROUND OF THE INVENTION

This is a continuation of U.S. Ser. No. 142,027 filed 1/11/88 now abandoned.

FIELD OF THE INVENTION

The present invention generally relates to storage of plural applicators and more particularly a tong shaped apparatus blocking a single opening of the dispenser. In this case I will use a mascara applicator and dispenser as an example.

PRIOR ART

Mascara applicators are usually comprised of a single brush or comb that is connected to a rod which is inserted into a mascara dispenser.

Applying mascara on soft eyelashes is like trying to write on a piece of paper without solid backing on it. Since eyelashes are soft and not stiff, when you apply mascara, the lashes keep moving away, coating only a small part of the lashes. This requires repeated brushing back and forth under and over with the applicator. Some people spend 20 to 30 minutes each time when they apply mascara, which is quite a long time. Those who have natually thick lashes, have and easier time applying mascara, but still have a need to curl their lashes. Also when people apply mascara heavily, it tends to bunch up the lashes. This forces people to try various ways of separating the lashes with needles, toothpicks other sharp objects. This is not only time consuming, but quite dangerous.

In 1984 Inventor Linda Holland invented double brush mascara tongs (U.S. Pat. No. 4,458,701) having a carrying case with a mascara reservoir. Holland's mascara comprised of tong shaped applicators as the present invention, however, dispenser has two openings. It is very clear why Holland's Invention includes two openings, because two round brushes and rods couldn't merge close enough to become one solid unit to insert into a single opening. My present invention corrects this problem by mascara tongs comprised of two applicators and blocking members becoming one unit, and insert into a single opening of the dispenser.

SUMMARY OF THE INVENTION

An apparatus and Dispenser kit of the present invention satisfies all the forgoing needs. An apparatus and Dispenser kit substantially as set forth in abstract. Therefore, the kit includes dispenser and "V" shaped tong apparatus or configuration of a pair of pliers or scissors. The long shaped apparatus is comprised of a pair of rods, left and right, which has a pivot at the upper end of the rods with a spring action. The pliers configuration is comprised of two rods that are pivotally joined at their own crossing by the pin, hinge or bolt. Both of the lower end of rods having blocking members and blocking members are connected to mascara applicators respectively. The rods above blocking members becomes the handle portion. The blocking members are comprised of two of half circular plugs and stopper, and rubber or plastic seal on one of inner panels of the half plugs. Even when apparatus is closed and inserted in the dispenser, the spring action from the pivot will force the two rods to open, this makes blocking members expend towards a single opening of the dispenser and insures tight sealing. While the apparatus is in the dispenser the stopper will assure that the handle will stay above the opening and be clean and dry.

The plug is tapered down for easy insertion and removal. The rods are comprised of two half round elongated shapes, but when they are in a closed position, rods becomes cylindrical. This position allows the two applicators and rods to be inserted into a single opening of the dispenser.

This method can be used in many situations such as mascara and dispenser, paint coating touch ups, cleaning devices and use simply as a sealing device.

I will continue in terms of using mascara and dispenser as an example.

The end of the left rod has a comb applicator, which is comprised of a generally flat base with double rows of teeth on the perimeter of the top of the base, and shorter teeth under the base. Applicant will refer to this as a "double comb". The other, the right rod end, having a brush applicator. The "Double comb" base has many holes to allow the brush bristles to pass through when the rods are in the closed position. This allows the mascara contents to coat all sides of the teeth and bristles of the applicators when the apparatus is in the dispenser. A flat piece of rubber seal is positioned on one of the plugs or rods for additional sealing purposes.

To use present invention, place one of the applicators above the eyelashes and the other under the lashes and close tightly for a few seconds to curl. For coating or separating, gently release the tension, then pull apparatus away from the eyelashes. Because the double comb and the single comb will be supporting each other, it will gently grip each lash while applying mascara to all sides of the lashes. This present invention curls, coats and separates eyelashes quickly and efficiently.

The apparatus is contained in one piece which can be made of either metal or plastic. The dispenser can be made of plastic or/and metal. some of the existing mascara dispensers can be used.

Many new inventions remove some of the existing advantages, but the present invention gives more coverage without sacrificing any of the advantages of the existing methods.

Further features of the kit are set forth in the following detailed description and accompanying drawings.

DRAWINGS

FIG. 7 is a schematic side perspective view of the second preferred embodiment of the Apparatus.

FIG. 8 is a schematic side perspective view of the third preferred embodiment of the Double Comb Applicator.

FIG. 9 is a schematic side view of the third preferred embodiment of the apparatus.

DETAILED DESCRIPTION

FIGS. 1, 2, 3, and 4.

Now referring more particularly to the accompanying drawings, a first preferred embodiment of the coating apparatus and dispenser Kit of the present invention is schematically depicted in FIGS. 1–4.

Figure 1:
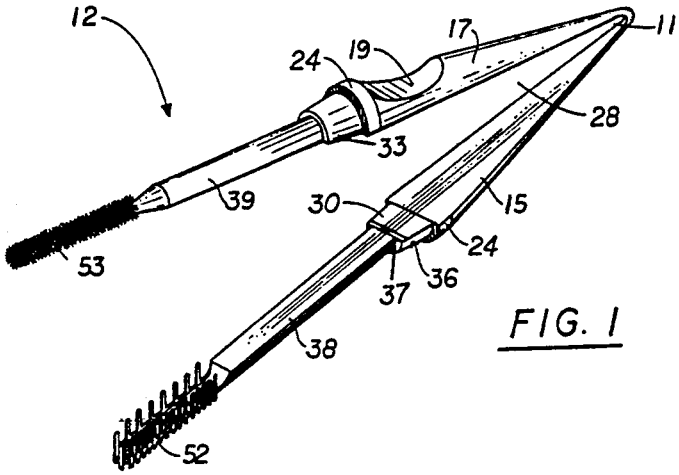
FIG. 1 is a schematic side perspective view of a first preferred embodiment of The Apparatus of the Assembly of the present invention.
Figure 2:
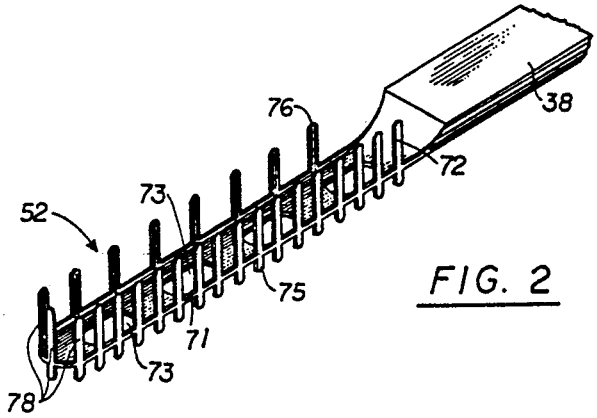
FIG. 2 is an enlarged schematic side perspective view of the Double Comb, applicator.
Figure 4:
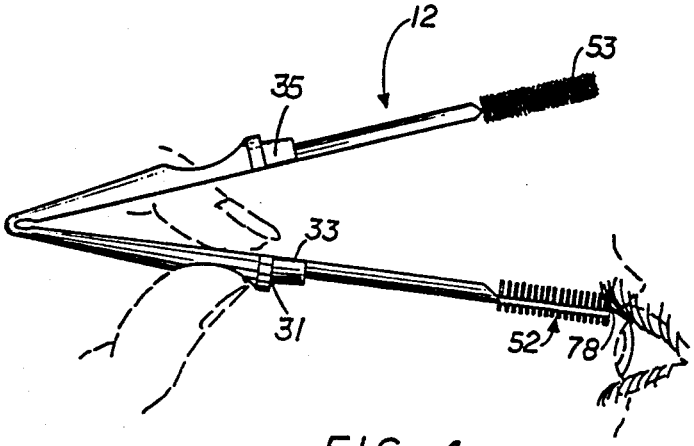
FIG. 4 is a schematic side view of first preferred embodiment of The Apparatus ready to apply and separate a few lashes at a time.

Thus, assembly 10 is shown, which comprises a coating apparatus 12 and dispenser 20. Apparatus 12 is comprised of half circular elongated right rod 39, and left rod 38. Lower end of the rod 39 is connected to applicator brush 53, and lower end of the rod 38 is connected to comb applicator 52. The brush applicator 53 may be any existing mascara brush or it may be a plastic brush that is made of the same material as in rod 38. Comb applicator 52 is comprised of generally rectangular base 71, having holes 73 and teeth 76, teeth 72 and teeth 78. The right hand row of the teeth 76 are widely spaced to separate the eyelashes for a more dramatic look. Left hand row of the teeth 72 is densely spaced to separate individual lashes. Teeth 78 are located on the front tip of the comb 52. When comb 52 and brush 53 are closed together, front teeth 78 and brush tips are able to grip a single eyelash for extra coating or separating (FIG. 4). Upper ends of the rods 38 and 39 are connected to two half circular plugs 36. Each plug 36 having inner flat side panel 33, outer half round side panel 35, bottom base 37 and upper bases 31 (FIGS. 1 and 4). Bottom bases 37 are connected to rod 38 and 39, and upper bases 31 are connected stoppers 24. Stoppers 24 are connected to handle 15 and 17. One of the plugs 36 has a rubber or plastic seal 30 (FIG. 1). Finger indentations 19 are located at the lower part of the handles and the upper ends of the handles are pivotally connected by U shape 11. Pivot 11 is bended and, can be any connecting element such as a hinge, spring etc. When handles 15 and 17 are closed, plugs 36 becomes a round plug, rods 39 and 38 also becomes a round elongated rod, and brush 53 will lay inside of the comb 52. This procedure makes it possible for apparatus 12 to insert into the dispenser 20. To insert the apparatus into dispenser single opening 64, close the apparatus 12 by fingers, pressing indentation 19. Spring action 28 is always trying to keep the apparatus in an open position which makes blocking members expend towards a single opening when apparatus in the dispenser.

Figure 3:
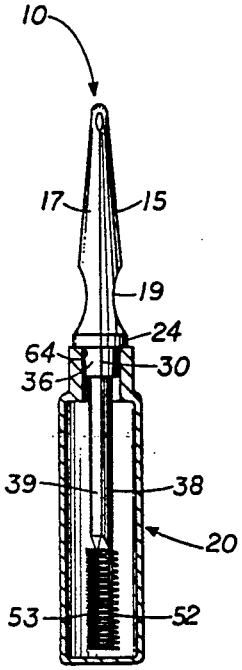
FIG. 3 is a schematic cross-section side view of first preferred embodiment of the assembly, The Apparatus residing in the Dispenser.

The stoppers 24 become a round shape covering the opening 64 and keeps the handle above the opening. (FIG. 3).

Figure 5:
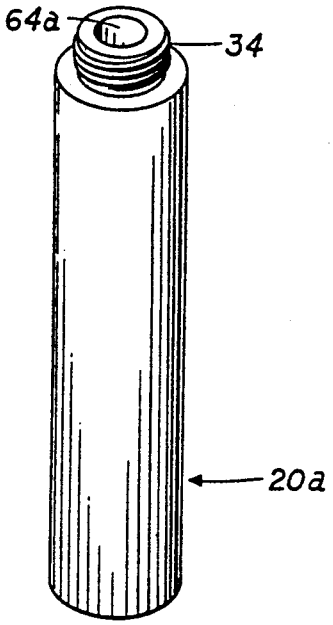
FIG. 5 is a schematic side perspective view of the second preferred embodiment of the Dispenser.
Figure 6:
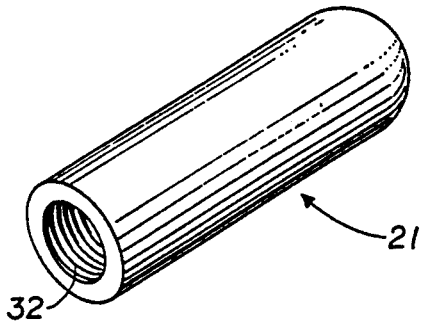
FIG. 6 is a schematic side perspective view of the second preferred embodiment of the dispenser Cap.

FIGS. 5, 6, and 7.

A second preferred embodiment of The Apparatus of the present invention is schematically depicted in FIGS. 5–8. Thus, Assembly 10*a* is shown. Components thereof similar to those of assembly 10 bear the same numerals, but are succeeded by the letter "a". Assembly 10*a* is identical to assembly 10 except as follow:

(a) applicator 53*a* is comprised of a generally rectangular base having shorter teeth 51 on the top of the base, and long teeth 50 and longer teeth 54 under the base. Teeth 50 are shorter than teeth 54 for easy and fast insertion of eyelashes;

(b) upper end rods 39*a* and 38*a* are directly connected to stoppers 24*a* ;

(c) rod 38*a* and 39 *a* are widened towards near the upper end and act as plugs 36*a*. Stopper 24*a* and rods 38*a* having a rubber seal 30*a*.

(d) Handle 17*a* and 15*a* are narrower than handle 15/17 to accommodate the cap 21, and cap 21 has thread 32.

(e) Dispenser 20*a* has threads 34 to match with cap thread 32, and any existing dispenser may be modified to accommodate the second preferred Apparatus.

FIGS. 8 and 9

A Third preferred embodiment of the apparatus 12*b* and 52*b* are schematically shown (FIGS. 8 and 9).

Apparatus 12*b* and applicator 52*b* is similar to apparatus 12*a* and applicator 52*a* and bears the same numerals but is succeeded by the letter "b". Applicator 52*b* is identical to 52*a* except as follows;

(a) the double comb is curved for a better fit in order to curl eyelashes.

(b) Apparatus 12*b* is comprised of handles 15*b* and 17*b*, and is pivottaly connected in a cross relationship by connecting elements 11*b*, such as hinge or pin. Third preferred embodiment is similar to pliers or scissors shape. Apparatus 12*b* can be used as a plug or connected with applicators as apparatus 12 or 12*a*.

(c) Blocking members are comprised of plug 36*b* and sealing member 30*b*, but eliminated the stoppers 24.

Various modifications, changes, alterations and additions can be made in the present invention, its components and their parameters. All such modifications, changes, alterations and additions as are within the scope of the appended claims form part of the present invention.

What is claimed is:

1. In combination, a container having an open end and an applicator for mascara inserted in said opening, said applicator comprising a pair of elongated rods pivotally connected at one of their respective ends, and at their other ends having first and second cooperating applicator members, said rods upon pivoting between a first non-parallel position and a second substantially parallel position matingly engage said first and second applicator members for cooperating insertion into said opening of said container, each of said rods including a first and second portion of a stopper member located substantially midway between the two ends of each rod, said first and second portions forming a stopper for said open end of the container by pivoting the rods to said second position, said rods including a handle portion on said ends opposite said first and second applicator members.

2. The combination of a container and an applicator as recited by claim 1, said first applicator member is an elongated brush or comb.

3. The combination of a container and an applicator as recited by claim 2, said second applicator member is a second comb having at least two spaced apart rows of teeth.

4. The combination of a container and an applicator as recited by claim 3, wherein upon pivoting of said rods to said second position, said brush or comb is received within the rows of said teeth of said second comb.

5. The combination of a container and an applicator as recited by claim 1, wherein said first and second applicator are curved.

* * * * *